US007854275B2

(12) United States Patent
Mock et al.

(10) Patent No.: US 7,854,275 B2
(45) Date of Patent: Dec. 21, 2010

(54) SPRING-OPERATED ANTI-STALL TOOL

(75) Inventors: Philip Wayne Mock, Costa Mesa, CA (US); Rudolph Ernst Krueger, IV, Houston, TX (US)

(73) Assignee: Western Well Tool, Inc., Anaheim, CA (US)

( * ) Notice: Subject to any disclaimer, the term of this patent is extended or adjusted under 35 U.S.C. 154(b) by 93 days.

(21) Appl. No.: 12/348,770

(22) Filed: Jan. 5, 2009

(65) Prior Publication Data

US 2009/0173539 A1 Jul. 9, 2009

Related U.S. Application Data

(60) Provisional application No. 61/009,972, filed on Jan. 3, 2008, provisional application No. 61/082,931, filed on Jul. 23, 2008.

(51) Int. Cl.
*E21B 17/07* (2006.01)

(52) U.S. Cl. ..... 175/57; 175/27; 175/321

(58) Field of Classification Search ..... 175/25, 175/26, 27, 57, 321; 173/8
See application file for complete search history.

(56) References Cited

U.S. PATENT DOCUMENTS

| | | | | | |
|---|---|---|---|---|---|
| 3,233,689 | A | * | 2/1966 | Whittle | 175/94 |
| 3,303,894 | A | * | 2/1967 | Varney | 175/40 |
| 3,407,886 | A | * | 10/1968 | Bennett | 175/27 |
| 3,675,727 | A | | 7/1972 | Clark | |
| 3,799,260 | A | | 3/1974 | Barrington | |
| 4,223,746 | A | | 9/1980 | Tanguy et al. | |
| 4,431,064 | A | | 2/1984 | Bright | |
| 4,660,656 | A | * | 4/1987 | Warren et al. | 175/26 |
| 4,721,172 | A | | 1/1988 | Brett et al. | |
| 4,768,598 | A | | 9/1988 | Reinhardt | |
| 4,936,397 | A | | 6/1990 | McDonald et al. | |
| 5,174,392 | A | | 12/1992 | Reinhardt | |
| 5,311,954 | A | * | 5/1994 | Quintana | 175/61 |
| 5,316,094 | A | * | 5/1994 | Pringle | 175/74 |
| 5,368,108 | A | | 11/1994 | Aldred et al. | |
| 5,368,110 | A | | 11/1994 | French | |
| 5,372,193 | A | | 12/1994 | French | |
| 5,394,951 | A | | 3/1995 | Pringle et al. | |
| 5,476,421 | A | | 12/1995 | Moore et al. | |
| 5,669,457 | A | | 9/1997 | Sebastian et al. | |
| 5,884,716 | A | | 3/1999 | Beasley | |
| 6,102,138 | A | | 8/2000 | Fincher | |

(Continued)

FOREIGN PATENT DOCUMENTS

| | | |
|---|---|---|
| GB | 2 439 178 A | 12/2007 |

(Continued)

*Primary Examiner*—David J Bagnell
*Assistant Examiner*—Blake Michener
(74) *Attorney, Agent, or Firm*—Christie, Parker & Hale, LLP

(57) ABSTRACT

An anti-stall tool in an oil well drilling assembly that controls reciprocation of the drill bit by a controller that alters weight-on-bit (WOB) depending upon measured downhole pressure or torque. The downhole controller keeps the drill bit rotating by maintaining WOB during normal drilling operations, increasing WOB if sensed working pressure indicates that drill bit loading or torque is undesirably low, and reversing WOB by applying a spring force for retracting the drill bit if excessive working pressure or torque is sensed.

20 Claims, 3 Drawing Sheets

U.S. PATENT DOCUMENTS

| | | | | |
|---|---|---|---|---|
| 6,202,762 | B1 | 3/2001 | Fehr et al. | |
| 6,230,813 | B1 | 5/2001 | Moore et al. | |
| 6,230,821 | B1 * | 5/2001 | Warren et al. | 175/27 |
| 6,467,557 | B1 | 10/2002 | Krueger et al. | |
| 6,568,485 | B2 | 5/2003 | Falgout, Sr. | |
| 6,594,881 | B2 | 7/2003 | Tibbitts | |
| 6,736,223 | B2 * | 5/2004 | Odell et al. | 175/57 |
| 6,758,279 | B2 | 7/2004 | Moore et al. | |
| 6,962,213 | B2 | 11/2005 | Hartwick | |
| 7,036,610 | B1 | 5/2006 | Vail, III | |
| 7,100,708 | B2 | 9/2006 | Koederitz | |
| 7,114,581 | B2 | 10/2006 | Aronstam et al. | |
| 7,139,219 | B2 | 11/2006 | Kolle et al. | |
| 7,174,975 | B2 | 2/2007 | Krueger et al. | |
| 7,677,334 | B2 * | 3/2010 | Blount et al. | 175/57 |
| 2001/0045300 | A1 * | 11/2001 | Fincher et al. | 175/26 |
| 2002/0007971 | A1 | 1/2002 | Beaufort et al. | |
| 2004/0140131 | A1 * | 7/2004 | Susman | 175/296 |
| 2008/0202816 | A1 | 8/2008 | Haughom et al. | |
| 2008/0264689 | A1 | 10/2008 | Blount et al. | |
| 2009/0173540 | A1 * | 7/2009 | Mock et al. | 175/25 |

FOREIGN PATENT DOCUMENTS

| | | | |
|---|---|---|---|
| NO | 324265 | B1 | 9/2007 |
| WO | WO 2004/090278 | A1 | 10/2004 |
| WO | WO 2006/075921 | A1 | 7/2006 |
| WO | WO 2008/134263 | A1 | 11/2008 |

* cited by examiner

SPRING-OPERATED ANTI-STALL TOOL

CROSS-REFERENCE

This application claims the priority date of U.S. Provisional Applications 61/009,972, filed Jan. 3, 2008, and 61/082,931, filed Jul. 23, 2008, which are incorporated herein in their entirety by this reference.

FIELD OF THE INVENTION

This invention relates to downhole drilling assemblies, and more particularly, to a spring-operated anti-stall tool for controlling weight on-bit during drilling operations.

BACKGROUND

Coiled tubing drilling requires the use of a downhole positive displacement motor (PDM) to rotate the drill bit. During drilling operations, the unloaded PDM rotates at a constant RPM and achieves a "freespin" motor pressure, with respect to the fluid flow rate. As the drill bit encounters the bottom of the hole and force is transferred to the bit, referred to as weight-on-bit (WOB), the motor will sense an increase in torque. The increase in torque is a result of increased resistance to rotating at the constant RPM (assuming a constant flow rate). In turn, the PDM requires additional pressure to turn the motor at the constant RPM while under increased resistance. If the resistance increases to a condition which prohibits the PDM from rotating (i.e. excessive WOB), a motor stall is encountered. During a motor stall, the motor stops turning, the downhole fluid path is severely restricted, and the surface pump pressure dramatically increases. This event can eventually cause a motor failure, which requires the drilling process to be stopped, and the coiled tubing to be fatigue-cycled as the bit is pulled off bottom and run back into the hole to start drilling again.

A downhole tool that monitors motor pressure and sharply reduces the occurrence of motor stalls will increase overall drilling efficiency by:

(1) Increasing the average rate of penetration. This is achieved by reducing the occurrences of pulling off-bottom every time the motor stalls.

(2) Decreasing the damage to PDMs through repeated motor stalls, thereby decreasing occurrence of downhole failure.

(3) Decreasing the fatigue cycles on the coiled tubing. This increases the number of wells a coiled tubing string can service.

By achieving a more efficient drilling operation, the operators can substantially increase the cost savings of drilling a well.

The present invention provides an anti-stall tool that controls WOB during drilling operations, resulting in improved overall drilling efficiency.

SUMMARY OF THE INVENTION

Briefly, this invention comprises an anti-stall tool positioned in a downhole assembly near the bottom of the tubing adjacent a positive displacement motor (PDM) and the drill bit. In one embodiment, the tubing comprises a coiled tubing, although the tubing also can comprise rotary drilling tubing. The anti-stall tool controls the force applied to the drill bit during drilling to prevent the bit from stalling under load. The working pressure range of the PDM is sensed during use by a hydraulic valve control system and is used as an input to the controller. The controller alters weight-on-bit (WOB) if the downhole pressure goes beyond either end of the working pressure range of the system. The controller keeps the drill bit rotating by (1) maintaining WOB during normal drilling operations, (2) increasing WOB if sensed working pressure indicates that drill bit loading is low, and (3) reducing WOB which reduces PDM back-pressure to retract the drill bit from the bottom if excessive working pressure is sensed due to increased torque at the PDM.

The anti-stall tool generally comprises one or more hydraulic cylinders for applying an axial force either in a forward direction or a reverse direction. The controller comprises a system of hydraulic valves adapted to control piston force in either the forward or reverse directions. An active stage of the anti-stall tool reacts to the PDM producing low downhole pressures (e.g. below a pre-set low pressure) by actuating one or more of the pistons in the downhole direction to increase WOB which reduces PDM back-pressure. When the PDM is operating within its normal operating pressure range, the controller locks the pistons in a passive mode, in which the pistons are sealed and the anti-stall tool transfers force from the tubing to the drill bit. If the controller senses a pre-set high pressure or greater due to high torque at the PDM, the valve system reverses hydraulic flow to the pistons, which reduces WOB to force the drill bit away from the bottom to reduce PDM back-pressure.

One embodiment of the invention comprises an anti-stall method for controlling drilling operations in a downhole assembly which includes a tubing that extends downhole, a drill bit carried on the tubing, a positive displacement motor (PDM) for rotating the drill bit, and an anti-stall tool adjacent the PDM. The method comprises sensing pressure in the PDM, providing a range of operating pressures for the PDM defined by high and low limits of operating pressures, and operating the anti-stall tool in: (1) an active stage for increasing WOB forces in the downhole direction when the low limit of operating pressure is sensed, (2) a reverse stage for providing a WOB force in the reverse direction when the high limit of operating pressure is sensed, and (3) an optional passive stage in which the anti-stall tool is locked to transfer WOB directly from the tubing to the drill bit when the PDM is operating within the limits of its normal operating pressure range.

One embodiment of the invention comprises a spring-operated anti-stall tool adapted for use in a downhole assembly which comprises a tubing for extending downhole, a drill bit carried on the tubing, and a positive displacement motor (PDM) adjacent the drill bit for rotating the drill bit during drilling operations. A spring-operated anti-stall tool is carried on the tubing and positioned adjacent the PDM for preventing stalling of the PDM due to excessive loads on the drill bit. The spring-operated anti-stall tool comprises at least one piston in a cylinder having a forward piston area and a reverse piston area, and a controller comprising a hydraulic valve system for controlling operation of the piston. The forward piston area receives hydraulic fluid to produce a force in the downhole direction. The reverse piston area contains a load spring adapted to apply an upward spring force on the piston. The controller adjusts WOB in response to sensed PDM operating pressure. The controller inputs a desired range of operating pressures for the PDM, including an upper limit and a lower limit. The controller is adapted to: (1) supply hydraulic fluid to the forward piston area to increase WOB force in the downhole direction when operating pressure in the PDM surpasses the lower limit; this compresses the load spring as the piston moves in the downhole direction; (2) vent the piston volume in the forward piston area so the compressed spring will push the tool uphole, to reduce WOB when operating pressure in the PDM exceeds the upper limit; and (3) optionally lock the piston in a passive state when the PDM is operating within its normal operating pressure range.

These and other aspects of the invention will be more fully understood by referring to the following detailed description and the accompanying drawings.

DETAILED DESCRIPTION

Figure 1:
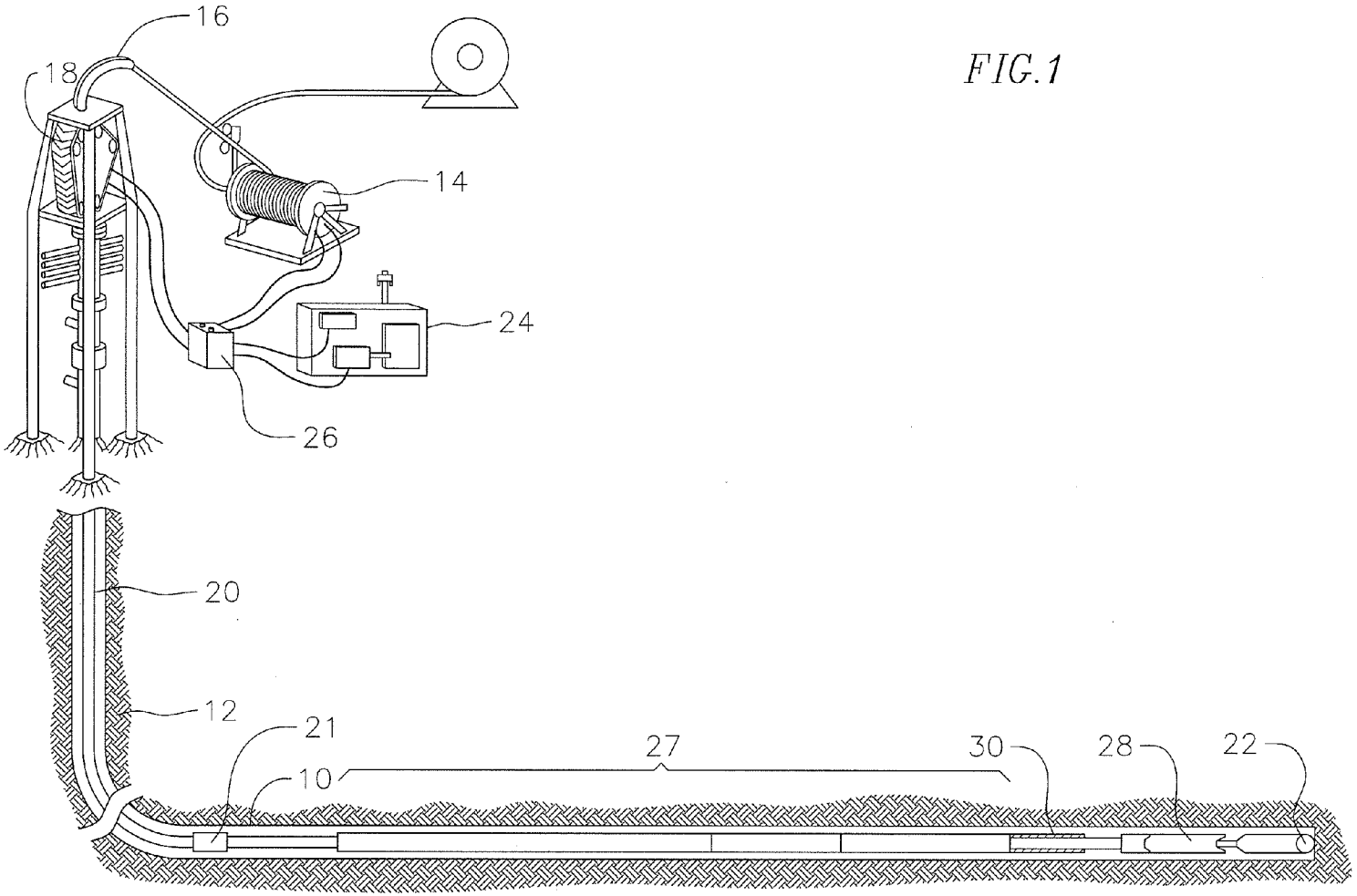
FIG. 1 is a schematic view showing a downhole assembly containing an anti-stall tool according to principles of this invention.

FIG. 1 is a schematic diagram illustrating a coiled tubing drilling system for drilling a well bore in an underground formation. The coiled tubing drilling system can include a coiled tubing reel 14, a gooseneck tubing guide 16, a tubing injector 18, a coiled tubing 20, a coiled tubing connector 21, and a drill bit 22 at the bottom of the well bore. FIG. 1 also shows a control cab 24, a power pack 26, and an alignment of other BHA tools at 27. A tractor (not shown), such as that described in U.S. Pat. No. 7,343,982, may be used to move downhole equipment within the bore. The '982 patent is incorporated herein in its entirety by this reference. During drilling, the downhole equipment includes a downhole motor 28, such as a positive displacement motor (PDM), for rotating the drill bit. A spring-operated anti-stall tool (AST) 30, according to principles of this invention, is positioned near the bottom of the coiled tubing, upstream from the downhole motor and the drill bit. In one embodiment, hydraulic back pressure produced within the coiled tubing is measured at the surface. Torque produced at the drill bit during drilling operations is directly related to back-pressure. As a result, hydraulic back-pressure measurements can be sensed and used as inputs to a hydraulic control valve system contained in the anti-stall tool.

The anti-stall tool 30 incorporates use of a series of hydraulic cylinders and as few as two pressure-actuated valves to control the applied weight-on-bit (WOB) while drilling. This tool will virtually create a real time, downhole motor pressure sensor that will alter the WOB to maintain a relatively constant drilling rate of penetration and provide feedback to the coiled tubing operator to adjust coiled tubing injector rates to match the PDM pressure.

The invention uses the working pressure range of the downhole positive displacement motor 28 to alter the WOB if the downhole pressure surpasses either end of the working range. During drilling operations, the AST will control the WOB through the use of three distinct operations: active WOB, passive WOB, and reverse.

Figure 2:
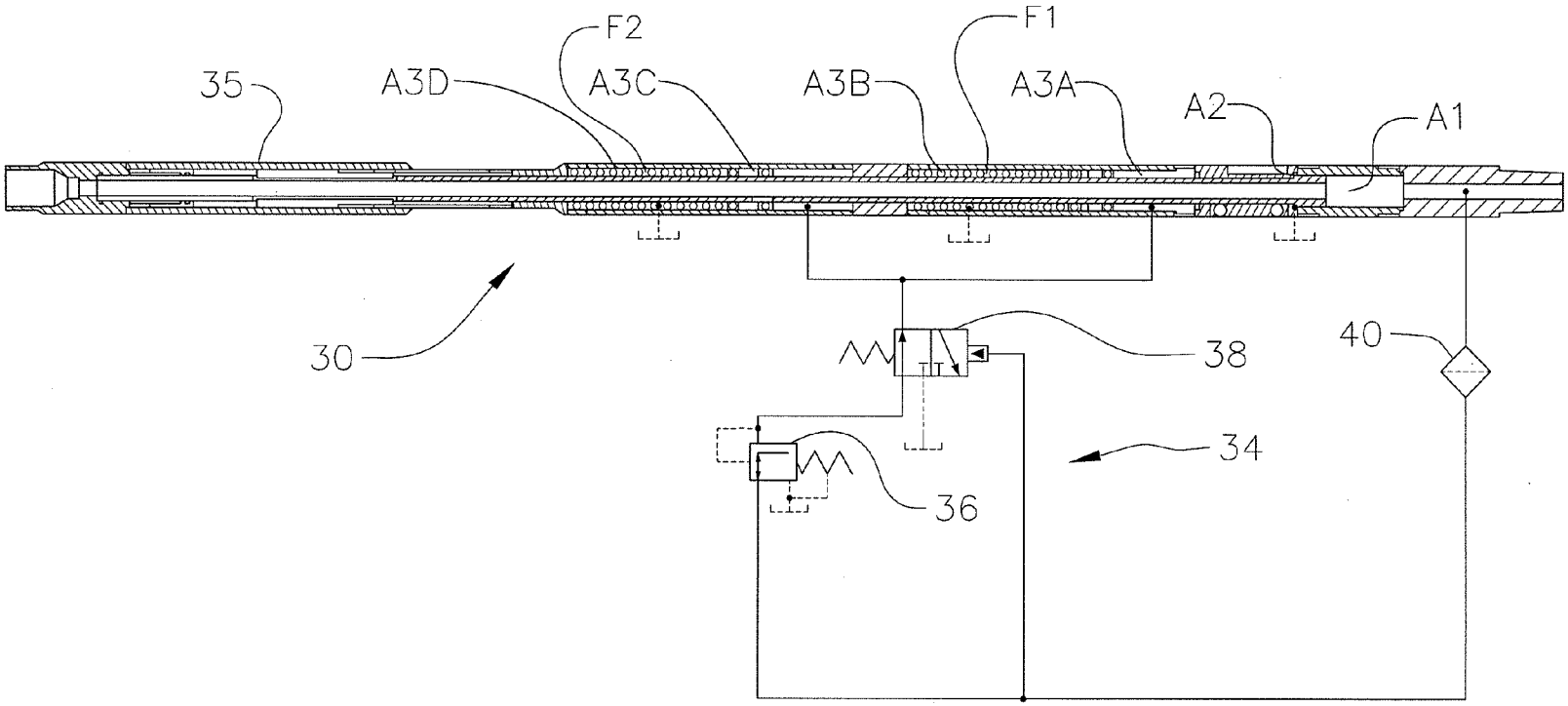
FIG. 2 shows a cross-sectional view of one embodiment of a spring-operated anti-stall tool.

FIG. 2 illustrates a spring-operated anti-stall tool 30 according to this invention. In the description to follow, motor pressure values are examples only; they are dependent upon and adjustable to specific motor requirements.

The FIG. 2 embodiment includes a series of axially aligned hydraulic cylinders with separate pistons that define piston areas A1 and A2, A3A and A3B, and A3C and A3D. The torque section of the tool is shown at 35. The piston area A3B contains a compression spring that applies a spring force F1 and a piston area A3D which contains a compression spring that applies a spring force F2. FIG. 2 also schematically shows a controller 34 contained in the anti-stall tool. The controller includes a pressure reducing valve 36 and a vent valve 38. Hydraulic fluid passes through a filter 40.

In the description to follow, specific operating pressure set points or values are related to operative ranges for coiled tubing equipment. Use of the anti-stall tool in rotary drilling operations, for example, would involve use of different operating pressure ranges or control valve set points.

The first stage of the spring operated anti-stall tool 30 is activated when the unloaded PDM produces low downhole pressures. For example, if the PDM 20 creates a back pressure of 200 psi, the spring-operated tool will be in the active WOB stage. This causes pressure to be supplied to all pistons that will produce a force in the downhole direction (A1, A3A and possibly A3C). This will compress and load the springs with a spring force F1 and F2. As the WOB is applied, the normal reaction is for the PDM to generate more pressure. As the tool senses the increase in pressure to 250 psi (adjustable to specific motor requirements), the pressure reducing valve 36 will shut off additional flow to the pistons and hydraulically lock the pistons in the passive WOB stage.

In the passive WOB stage, the spring-operated tool transfers the force from the coil to the bit. The tool is acting as a rigid member and is monitoring the PDM back-pressure. The pressure reducing valve 36 is closed and is sealing the fluid in the pistons (A3A and possibly A3C) that produce a force in the downhole direction. All of the resultant pressure from the WOB is contained in the sealed piston volumes.

During the final stage of the spring-operated tool, the back pressure due to high torque in the PDM triggers the vent valve 38 to pull the bit off-bottom. Once the back pressure reaches 1,000 psi (adjustable to specific motor requirements), the vent valve 38 vents piston volumes A3A and A3C. The resultant force F1 and F2 of the compressed springs will push the tool uphole, reducing WOB and thereby reducing the PDM back-pressure. As the PDM back-pressure falls below the vent valve setting (including hysteresis), the tool will switch back to one of its other stages of operation.

Figure 3:
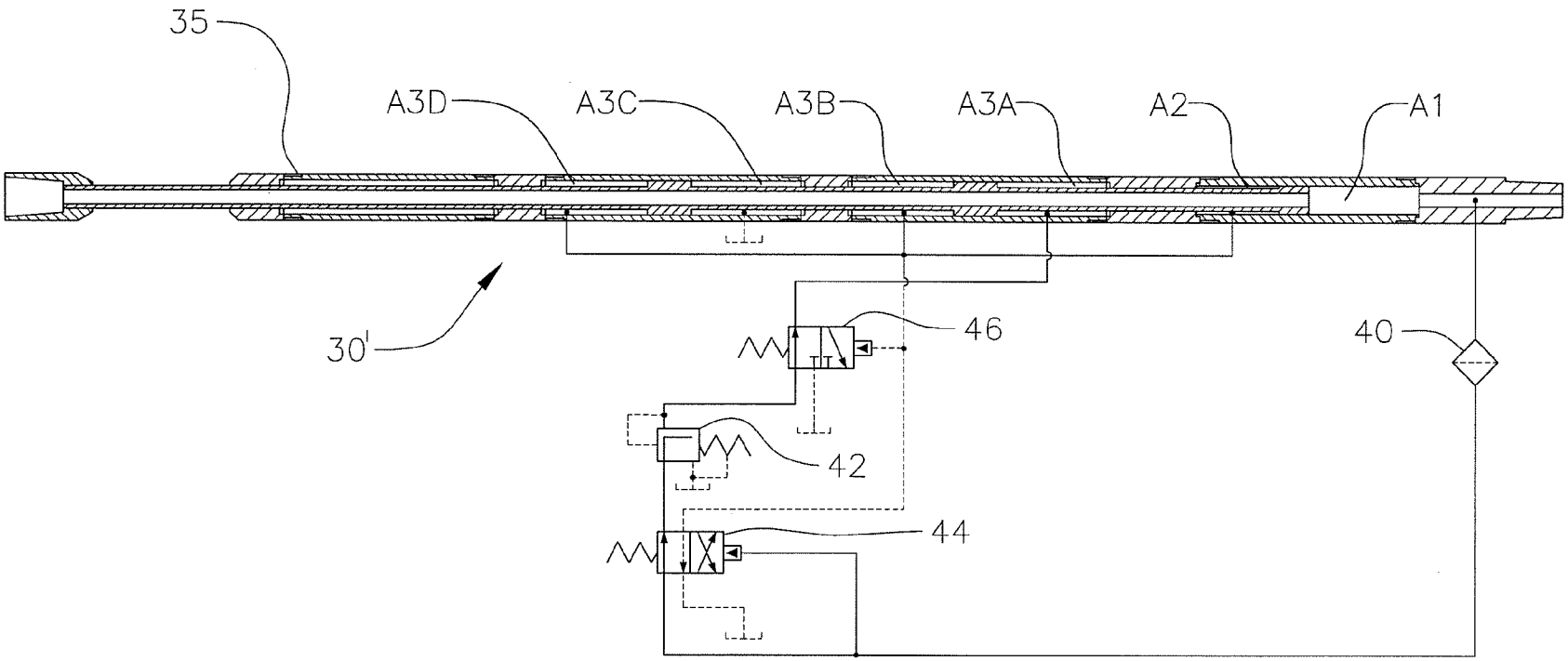
FIG. 3 shows a cross-sectional view of one embodiment of a hydraulic-operated anti-stall tool.

FIG. 3 shows a hydraulic anti-stall tool 30' which comprises an alternative to the spring-operated anti-stall tool.

The first stage of the hydraulic anti-stall tool is activated when the unloaded PDM produces low downhole pressures. For example, if the PDM creates a back pressure of 200 psi, the tool will be in the active WOB stage. This causes pressure to be supplied to all pistons that will produce a force in the downhole direction (A1, A3A and possibly A3C). As the WOB is applied, the normal reaction is for the PDM to generate more pressure. As the tool senses increase in pressure to 250 psi (adjustable to specific motor requirements), the pressure reducing valve 42 will shut off additional flow to the pistons and hydraulically lock the pistons in the passive WOB stage.

In the passive WOB stage, the hydraulic anti-stall tool transfers the force from the coiled tubing to the bit. The tool is acting as a rigid member and is monitoring the PDM back-pressure. The pressure reducing valve is closed and is sealing the fluid in the pistons (A3A and possibly A3C) that produce a force in the downhole direction. All of the resultant pressure from the WOB will be contained in the sealed piston volumes.

During the final stage of the hydraulic anti-stall tool, the back-pressure due to high torque in the PDM triggers the reverser valve 44 and vent valve 46 to reduce WOB. Once the back-pressure reaches 1,000 psi (adjustable to specific motor requirements), the reverser valve 44 switches the flow of fluid to the pistons that produce force in the uphole direction (A2, A3B, A3D). At the same time, the vent valve 46 vents the opposite side of those pistons. This allows the tool to travel uphole, reducing WOB and thereby reducing the PDM back-pressure. As the PDM back pressure falls below the reverser valve 44 setting (including hysteresis), the reverser valve 44 will switch back to its original position.

A difference between the tools shown in FIGS. 2 and 3 is how the tool produces force in the uphole direction. The spring-operated tool can have a total force available from the springs F1 and F2. The springs can produce different forces depending on the spring used and/or the displacement allowed. The use of springs simplifies the design of the tool by eliminating the reverser valve and its associated passages to connect it to the vent valve and pressure reducing valve. This also eliminates the longest gun-drilled hole in the shaft and reduces the total number of gun-drilled holes to one. The use of springs also can limit the stroke length of the tool to 4 to 8 inches, which also simplifies the tool (shorter torque keys and cylinders). Published information on this technology has stated that stroke lengths of 4 to 5 millimeters have produced acceptable results.

The anti-stall tool operates as an open loop system. Drilling fluid from the surface is pumped down the bore in the tubing through the tool, to the motor for rotating the drill bit. Most of the fluid flow in the system is used for driving the drill bit. A small amount of the fluid is used for the controller and is jetted out to the sides and into the annulus during use.

The hydraulic anti-stall tool operates on piston area ratios and will work over a broader range of pressures. If the stroke of the tool is shortened, the overall length of this tool will be shorter than the spring-operated tool.

The anti-stall tool is designed to be in the fully expanded position at low pressures. This bias allows the tool to have the full length of stroke available to retract as much as needed until the PDM back-pressure reduces below the lower limit of the vent valve. The anti-stall tool will then try to fully expand, but the pressure may rise to the pressure control valve setting or higher and limit the expansion. Therefore, the long stroke length will allow several retraction steps before the stroke length is used up. The coiled tubing operator can adjust the input speed of the coiled tubing into the hole to prevent the anti-stall tool from fully retracting. The operator will see a change in pump pressure with each retraction to signal the need to reduce the coiled tubing input speed.

The anti-stall tool includes splines in a torque section 35 which contains an outer spline housing and splines contained internally on the piston housing. The splines allow the BHA to maintain its orientation relative to the motor and drill bit, without undesired twisting. The splines allow the tool to be used with a steerable BHA. Steerable BHAs can be controlled to drill the hole to a desired location, while changing the direction of the hole while drilling to achieve this goal. The splines allow the PDM and bit to maintain alignment with the orienting tools that would be uphole of the anti-stall tool. The torque load is transferred from the PDM across the outermost housings and across the spline of the anti-stall tool to the tools uphole of the anti-stall tool. The inner shafts do not see direct loading due to torque. The spline section functions in both the expansion and retraction of the anti-stall tool.

A key feature of the anti-stall tool is the single input necessary for the tool to operate. The tool need only sense and respond to the back-pressure created by the PDM. Stated another way, the anti-stall tool operates on constant (although adjustable) working pressure set points. The fixed set points can be fine-tuned to control the thresholds at which the control valves open and close, and as a result, drill bit penetration rate is more uniform.

An alternate embodiment of the invention comprises a two-phase anti-stall method for controlling drilling operations in a downhole assembly, which includes the tubing that extends downhole, the drill bit carried on the tubing, the positive displacement motor (PDM) for rotating the drill bit, and the spring-operated anti-stall tool adjacent the PDM. This method comprises sensing pressure in the PDM, providing a range of operating pressures for the PDM defined by high and low limits of operating pressures, and operating the anti-stall tool in: (1) an active stage increasing WOB forces in the downhole direction when the low limit of operating pressure is sensed, and (2) a reverse stage reducing WOB by actuating the load spring, when the high limit of operating pressure is sensed. Appropriate settings of the pressure reducing valve and vent valve can control the tool so as to shift between the active and reverse stages.

The anti-stall tool also can be operated by the two-phase method, combined with a passive range that operates (as described above) between a small range of pressure settings.

A further alternative embodiment of the invention comprises a hydraulic-operated system controller using a two-position/four-way valve described in a concurrently filed non-provisional application entitled "Anti-Stall Tool for Downhole Drilling Assemblies," assigned to the same assignee as the present application, and naming Phillip Wayne Mock and Rudolph Ernst Krueger IV as joint inventors. This application is incorporated herein by this reference.

Different orifice adjustments can be used to control the speed at which the tool responds. In FIG. 3, the orifice is not shown. The orifice can be on the exhaust of the reverser valve. Using the high and low limits of the operating pressures, orifice sizes can be calculated to restrict the volumetric flow rate of fluid exhausted through the valve and thereby control the speed at which the tool expands or retracts. The expansion or retraction of the tool can be controlled individually by different orifice sizes. The speed at which the tool responds also can be adjusted by controlling spring force.

As an alternative, WOB can be controlled by a combination of control valve settings and adjustments to orifice sizes.

The following are features of the present invention:

(1) Active WOB: The tool will reset into the fully extended position when the pressure falls below 300 psi. If a motor stall has occurred and the AST has pulled the bit off bottom, the active WOB stage will produce a minimum WOB and thrust the bit downhole until the PDM pressure exceeds 300 psi. (Pressures are dependent upon specific motor requirements.)

(2) Passive WOB: Shuts off the active WOB stage and allows the coiled tubing to transfer WOB to the bit. Prevents excessive WOB that can be developed as PDM pressure rises and acts on the pistons producing force downhole.

(3) Reverse: Reduces WOB to prevent motor stalls.

(4) Torque section transfers torque through the AST into the coiled tubing.

A downhole tool that monitors motor pressure and sharply reduces the occurrence of motor stalls will increase the overall drilling efficiency by:

(1) Increasing the average rate of penetration. This is achieved reducing the occurrences of pulling off bottom for motor stalls.

(2) Decreasing the damage to PDMs through repeated motor stalls, thereby decreasing occurrence of downhole failure.

(3) Decreasing the fatigue cycles on the coiled tubing. The increases the number of wells a coiled tubing string can service.

By achieving a more efficient drilling operation, the operators can substantially increase the cost savings of drilling a well.

Although the invention has been described in connection with oil well drilling and use with a coiled tubing, the invention has other applications, including: jointed pipe, or rotary drilling; in operations besides drilling where it is useful to retract a tool at high pressures; or where adjustments to the drill bit are made to keep contact with the formation or to pick up the bit completely off the formation. Although the invention has been described with reference to a drill bit used in drilling oil wells in underground formations, the invention also may be used with other pressure-inducing tools such as high pressure jetting tools.

The anti-stall tool cylinders and valves may be manufactured from various corrosion-resistant materials including tungsten carbide, Inconel, high strength nickel alloyed steel such as MP35, beryllium-copper, and the like.

What is claimed is:

1. A spring-operated anti-stall tool adapted for use in a downhole assembly comprising a tubing for extending downhole; a drill bit carried on the tubing; and a drive motor adjacent the drill bit for rotating the drill bit during drilling operations; the spring-operated anti-stall tool carried on the tubing and positioned adjacent the motor for preventing stalling of the motor due to excessive loads on the drill bit, the anti-stall tool including at least one piston in a cylinder having a forward piston area and a reverse piston area, and a controller comprising a hydraulic valve system for controlling operation of the piston, the forward piston area receiving hydraulic fluid to produce a force in the downhole direction, the reverse piston area containing a load spring adapted to apply an upward spring force on the piston, the controller sensing operating pressure of the drive motor and setting a desired range of operating pressures for the motor, including an upper limit and a lower limit, the controller adapted to: (1) supply hydraulic fluid to the forward piston area to increase force in the downhole direction to increase weight-on-bit (WOB) when operating pressure in the motor surpasses the lower limit, thereby compressing the load spring as the piston moves in the downhole direction; (2) vent the piston volume in the forward piston area so the compressed spring can expand to push the tool uphole to retract the drill bit, to decrease WOB when operating pressure in the motor exceeds the upper limit; and (3) optionally lock the piston in a passive state when the motor is operating within its normal operating pressure range under the bias of the spring.

2. Apparatus according to claim 1 in which the drive motor comprises a positive displacement motor (PDM), and in which the tubing comprises a coiled tubing for supplying hydraulic pressure to the drive motor.

3. Apparatus according to claim 2 in which the tool includes a spline connection for maintaining orientation between BHA equipment and the PDM and drill bit.

4. Apparatus according to claim 1 in which the tubing and the anti-stall tool are adapted to pass drilling fluid to the drive motor for rotating the drill bit during use, and in which the controller is adapted to operate on a small fraction of the drilling fluid during use, without affecting operation of the drill bit.

5. A spring-operated anti-stall tool positioned in a downhole assembly near the bottom of a tubing adjacent a positive displacement motor (PDM) and a drill bit, the anti-stall tool having a controller for controlling the force applied to the drill bit during drilling via at least one piston and cylinder containing a compression spring for controlling weight-on-bit (WOB), to prevent the bit from stalling under load, the working pressure range of the PDM sensed during use and provided as an input to the controller, the controller adjusting WOB if the downhole pressure goes beyond either end of a preset working pressure range of the PDM, the controller (1) maintaining WOB during normal drilling operations, (2) increasing WOB if sensed working pressure indicates that drill bit loading is low, thereby causing compression of the control spring, and (3) reversing WOB by releasing spring force to retract the drill bit away from the bottom if excessive working pressure is sensed due to increased torque at the PDM.

6. Apparatus according to claim 5, in which the anti-stall tool comprises one or more hydraulic cylinders for applying an axial force either in a forward direction or a reverse direction, the controller comprising one or more hydraulic valves adapted to control piston force in the forward direction; an active stage of the anti-stall tool reacting to the PDM producing low downhole pressures by actuating one or more of the pistons in the downhole direction to increase WOB and thereby increase PDM back-pressure, the controller locking the pistons in a passive mode, in which the pistons are sealed and the anti-stall tool transfers force from the tubing to the drill bit, when the PDM is operating within its normal operating pressure range, the controller sensing a preset high pressure or greater due to high torque at the PDM to reduce WOB by releasing the spring force for retracting the drill bit away from the bottom to thereby reduce PDM back-pressure.

7. Apparatus according to claim 6 in which the tubing comprises a coiled tubing for supplying hydraulic pressure to the drive motor.

8. An anti-stall method for controlling drilling operations in a downhole assembly which includes a tubing that extends downhole, a drill bit carried on the tubing, a drive motor for rotating the drill bit, and a spring-operated anti-stall tool adjacent the motor, the method comprising sensing pressure in the motor, providing a range of operating pressures for the motor defined by high and low limits of operating pressures, and operating the anti-stall tool in: (1) an active stage increasing WOB forces in the downhole direction by applying pressure to the anti-stall tool against the bias of a compression spring therein, when the low limit of operating pressure is sensed, (2) a reverse stage for providing a WOB force in the reverse direction via the compression spring bias, when the high limit of operating pressure is sensed, and (3) an optional passive stage in which the anti-stall tool is locked to transfer torque directly from the tubing to the drill bit when the drive motor is operating within the limits of its normal operating pressure range.

9. The method according to claim 8 in which the drive motor is a positive displacement motor.

10. The method according to claim 8 in which the tubing comprises a coiled tubing for supplying hydraulic pressure to the drive motor.

11. The method according to claim 8 in which the tubing and the anti-stall tool pass drilling fluid to the drive motor for rotating the drill bit during use, and in which WOB is controlled by the anti-stall tool operating on a small fraction of the drilling fluid without affecting operation of the drill bit.

12. The method according to claim 8 in which orifice sizes in the anti-stall tool are adjusted to control speed of drilling.

13. The method according to claim 12 in which WOB is controlled by a combination of orifice sizes and control valve settings.

14. A spring-operated anti-stall tool adapted for use in a downhole assembly which comprises a tubing for extending downhole, a drill bit carried on the tubing, a drive motor adjacent the drill bit for rotating the drill bit during drilling operations, the spring-operated anti-stall tool adapted for being carried on the tubing and positioned adjacent the motor for preventing stalling of the motor due to excessive loads on the drill bit, the spring-operated anti-stall tool comprising at least one piston in a cylinder having a forward piston area and a reverse piston area, and a controller comprising a hydraulic valve system for controlling operation of the piston, the forward piston area receiving hydraulic fluid to produce a force in the downhole direction, the reverse piston area containing a load spring adapted to apply an upward spring force on the piston, the controller adapted to control weight-on-bit (WOB) in response to sensed working pressure of the drive motor and input settings defining a desired range of operating pressures for the motor, including an upper limit and a lower limit, the controller adapted to: (1) supply hydraulic fluid to the forward piston area to increase WOB when operating pressure in the PDM surpasses the lower limit, thereby compressing the load spring as the piston moves in the downhole direction; (2) vent the piston volume in the forward piston area so the spring will reduce WOB by applying a spring force to the piston in the uphole direction when operating pressure in the motor exceeds the upper limit; and (3) optionally lock the piston in a passive state when the motor is operating within its normal operating pressure range.

15. Apparatus according to claim 14 in which the drive motor comprises a positive displacement motor (PDM), and in which the tubing comprises a coiled tubing for supplying hydraulic pressure to the drive motor.

16. Apparatus according to claim 14 in which the anti-stall tool is adapted to pass drilling fluid to a drive motor for rotating the drill bit during use, and in which the controller is adapted to operate on a small fraction of the drilling fluid during use, without affecting operation of the drill bit.

17. A spring operated anti-stall tool comprising:

an outer housing, a piston assembly slidably disposed in the outer housing, the piston assembly having an internal passageway extending therethough for delivering drilling fluid to a drive motor and for rotating a drill bit adapted for positioning downhole from the anti-stall tool, a load spring positioned in the housing for applying a spring force to the piston assembly for axially shifting the piston assembly from an extended position relative to the housing, for reducing weight-on-bit-(WOB) to the drill bit, the piston assembly including at least one piston slidable in the housing in response to the spring force applied by the load spring, a forward piston area on a side of the piston opposite the load spring, and a reverse piston area on a side of the piston opposite the forward piston area, a hydraulic controller for supplying hydraulic fluid to the forward piston area in response to an external pressure input exceeding a lower limit, for applying force to the piston to axially shift the piston assembly toward the extended position against the bias of the load spring, to thereby increase WOB, and the hydraulic controller adapted to reduce hydraulic pressure acting on the piston in the forward piston area, in response to an external pressure input exceeding an upper limit, thereby causing the load spring to apply a spring force to the piston to shift the piston assembly to retract the piston assembly into the housing, to thereby reduce WOB.

18. Apparatus according to claim 17 in which the hydraulic controller is adapted to sense operating pressure of a drive motor for operating a drill bit positioned downhole from the anti-stall tool, to thereby supply said hydraulic fluid to either the forward or reverse piston areas, in response to input settings in the controller defining desired upper and lower operating pressures for the drive motor.

19. Apparatus according to claim 17 in which the anti-stall tool is adapted to pass drilling fluid to a drive motor for rotating a drive drill bit during use, and in which the controller is adapted to operate on a small fraction of the drilling fluid during use without affecting operation of the drill bit.

20. Apparatus according to claim 17 in which the controller vents the forward piston area to enable the compressed load spring to push the piston assembly uphole to decrease WOB.

* * * * *